US006727913B2

(12) United States Patent
Hoppenbrouwers et al.

(10) Patent No.: US 6,727,913 B2
(45) Date of Patent: Apr. 27, 2004

(54) METHOD AND DEVICE FOR DISPLAYING IMAGES ON A MATRIX DISPLAY DEVICE

(75) Inventors: Jurgen Jean Louis Hoppenbrouwers, Eindhoven (NL); Antonius Hendricus Maria Holtslag, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 198 days.

(21) Appl. No.: 10/055,369

(22) Filed: Jan. 23, 2002

(65) Prior Publication Data

US 2002/0145619 A1 Oct. 10, 2002

(30) Foreign Application Priority Data

Jan. 25, 2001 (EP) ..... 01200272

(51) Int. Cl.[7] ..... G09G 5/02; G09G 5/10; G09G 3/36

(52) U.S. Cl. ..... 345/690; 345/89; 345/596

(58) Field of Search ..... 345/89, 690, 596; 358/445

(56) References Cited

U.S. PATENT DOCUMENTS 5,245,444 A * 9/1993 Hashimoto ..... 358/445
6,104,365 A 8/2000 Towler et al. ..... 345/89
6,147,792 A 11/2000 Jones et al. ..... 359/320
6,236,380 B1 5/2001 Wani et al. ..... 345/60
6,388,677 B1 * 5/2002 Doyen et al. ..... 345/690
6,388,678 B1 * 5/2002 Kasahara et al. ..... 345/690
6,417,864 B1 * 7/2002 Jones et al. ..... 345/596

FOREIGN PATENT DOCUMENTS

EP 0874349 A1 10/1998 ..... G09G/3/28
EP 0880125 A1 11/1998 ..... G09G/3/36
EP 0890941 B1 1/1999 ..... G09G/3/28
EP 0953956 A1 11/1999 ..... G09G/3/20

* cited by examiner

*Primary Examiner*—Chanh Nguyen
*Assistant Examiner*—Uchendu O. Anyaso

(57) ABSTRACT

The present invention provides a method of displaying successive image frames or fields on a matrix display device, said display device comprising a predetermined number of display lines each including a predetermined number of picture elements, wherein said pixels are coded in subfields and said matrix display device is driven by said subfields and wherein the luminance values to be displayed are derived from original luminance values having a higher number of bits than the number of bits to be displayed by a pixel element, said method further comprising the following steps:

using one or more of the subfields with the lowest or lower weight(s) in a dithering process; and addressing two or more lines simultaneously for supplying common values to one or more subfields having a higher weight than said lowest or lower weight(s) of the pixels of said lines with respective common values.

7 Claims, 11 Drawing Sheets column →
row ↓
| | | | | | | | | | | | | |
|---|---|---|---|---|---|---|---|---|---|---|---|---|
| X | X | X | X | X | X | X | X | X | X | X | X | X |
| X | X | X | X | X | X | X | P | A | O | O | O | O |
| O | O | O | O | O | O | D | C | B | O | O | O | O |
FIG. 15
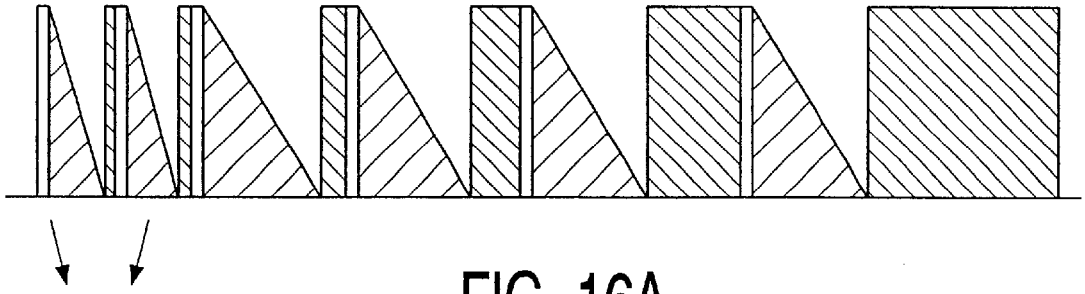
doubled subfields
FIG. 16A
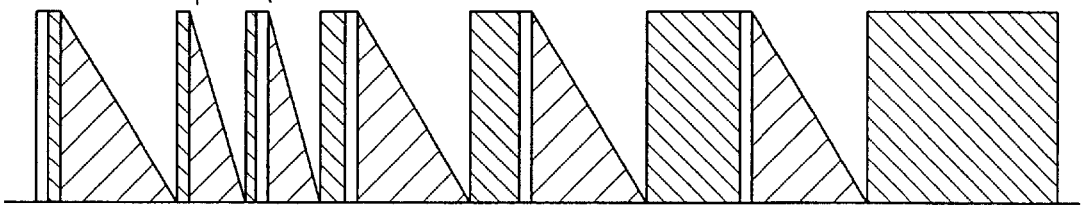
FIG. 16B

| original data | PLD data | shifted PLD data, without correction | shifted PLD data, with correction |
|---|---|---|---|
| 0 = 000000 | 000001 = 1 | 000000 = 0 | 000000 = 0 |
| 1 = 000001 | 000001 = 1 | 000001 = 1 | 000001 = 1 |
| 31 = 011111 | 100000 = 32 | 100001 = 33 | 100000 = 32 |
| 32 = 100000 | 100000 = 32 | 100000 = 32 | 100000 = 32 |
| 13 = 001101 | 001110 = 14 | 001111 = 15 | 001110 = 14 |
| 15 = 001111 | 001110 = 14 | 001111 = 15 | 001111 = 15 |
| 44 = 101100 | 101101 = 45 | 101010 = 42 | 101011 = 43 |
| 10 = 001010 | 001001 = 9 | 001010 = 10 | 001010 = 10 |

METHOD AND DEVICE FOR DISPLAYING IMAGES ON A MATRIX DISPLAY DEVICE

FIELD OF THE INVENTION

The invention relates to a method of displaying images on a subfield driven matrix display device, including plasma display panels (PDPs), plasma-addressed liquid crystal panels (PALCs), liquid crystal displays (LCDs), Polymer LED (PolyLEDs), Electroluminescent (EL), used for personal computers, television sets, etc.

The invention further relates to a display device comprising a receiving circuit for receiving luminance data comprising original luminance value data of pixels, the display device further comprising a display panel comprising a set of lines $r_1 \ldots r_M$, and a driver circuit for supplying line luminance value data to said lines, said lines being grouped in sets of neighboring or adjacent lines, wherein a common value for the multiple line addressed sub-fields is addressed simultaneously to a set of lines.

BACKGROUND OF THE INVENTION

Methods of displaying luminance levels in a plasma display panel are known from EP 0 890 941. In these methods the high weight subfields are addressed for each display line, and the low weight subfields are addressed for only part of the display lines. These methods allow e.g. a reduction of the address period by a factor of two for doubled subfields, or depending on the number of doubled subfields—e.g. of the total address period by 25%, thereby allowing a substantial increase of the duration of the sustain period.

Also in EP-A-0 874 349 a process for addressing bits on more than one line of a plasma display is disclosed.

In the method disclosed in EP-A-0 953 956 and EP-A-0 880 125 an improved method for displaying grey levels with reduced error is disclosed. Analog grey values are distributed over a number of pixels. Both spatial and temporal dithering as such are disclosed.

SUMMARY OF THE INVENTION

It is an object of the invention to provide a method of displaying successive image frames or fields on a display device so that the picture quality is improved, more particular so that resolution is improved and motion artifacts are avoided as much as possible.

The present invention provides a method of displaying successive image frames or fields on a matrix display device, said display device comprising a predetermined number of display lines each including a predetermined number of picture elements, wherein said pixels are coded in subfields and said matrix display device is driven by said subfields and wherein the luminance values to be displayed are derived from original luminance values having a higher number of bits or grey levels than the number of bits or grey levels to be displayed by a pixel element, said method further comprising the following steps:

- using one or more of the subfields with the lowest or lower weight(s) in a dithering process; and
- addressing two or more lines simultaneously for supplying respective common values to one or more subfields having a higher weight than said lowest or lower weight(s) of the pixels of said lines.

According to the present invention the partial line doubling is shifted to less significant subfields, however, excluding the one, two or more least significant subfields so that these subfields can be used for dithering.

Various dithering methods are known as such. In a preferred embodiment use is made of Floyd-Steinberg error diffusion.

It is possible to use averaging or copying of bits (subfield) for partial line doubling (excluding the least significant subfield(s)). However it is preferred to use further correction methods to further eliminate image errors due to the dithering and/or the partial line doubling.

In a further preferred embodiment addressing of a set of adjacent lines is performed differently for successive frames or fields, and/or for different regions of the display device and/or for different subfields.

By grouping the lines differently into successive frames and to different areas of the display, the address period is further reduced, avoiding loss of resolution.

Further advantages, features and details of the present invention will be elucidated in the light of the following description of preferred embodiments thereof with references to the annexed drawings, in which:

FIG. 1 schematically illustrates a prior art method (single line addressing);

FIG. 2 shows a subfield distribution, and the time gain obtained by double line addressing of the three least significant subfields;

FIG. 3 schematically illustrates a method in which double line addressing is used;

FIG. 4 schematically illustrates a method, in which double line and double frame addressing are used;

FIG. 5 schematically illustrates methods in which different multiple line and multiple frame addressing are used;

FIG. 6 schematically illustrates methods in various combinations;

FIG. 7 schematically illustrates a method according to the invention in which double surface addressing is used;

FIG. 8 shows a block diagram of a display apparatus according to an embodiment of the invention.

FIG. 9 schematically shows a matrix display device;

FIG. 10 schematically shows an embodiment of the invention, with a numerical example;

FIG. 11 schematically shows a simplified embodiment of the invention, applicable to binary sub-fields, a numerical example being shown in FIG. 12;

FIGS. 13 and 14 schematically show simplified embodiments, applied to non-binary sub-fields;

FIG. 15 shows a diagram to structurate Floyd-Steinberg error diffusion;

FIGS. 16A resp. 16B show subfield doubling schemes for explaining the present invention;

A matrix display panel such as a plasma display panel comprises a set of data electrodes usually extending in the column direction and a set of scanning electrodes usually extending in the row direction.

Figure 1:
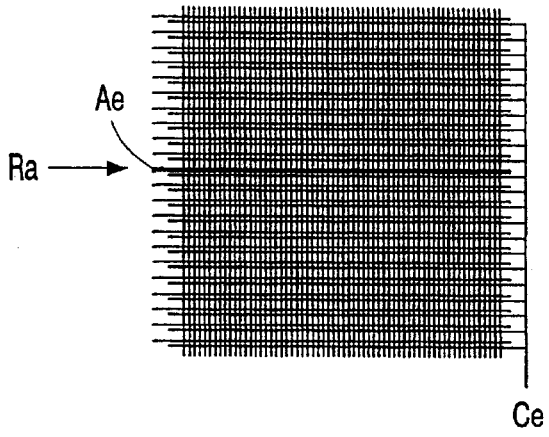
Figure 2:
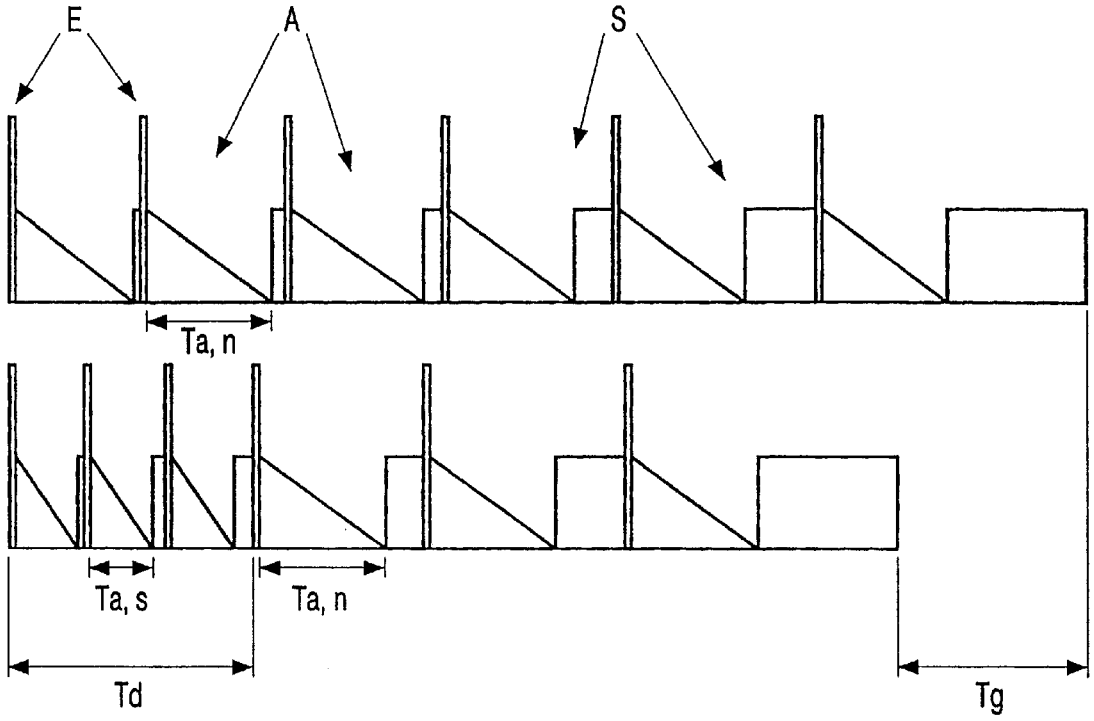

FIG. 1 shows a display panel, where each row is addressed individually. Two electrodes are associated with each row; an address electrode Ae and a common electrode Ce. The arrow indicates the addressed row Ra. This leads to the timing diagram of a field shown in the upper half of FIG. 2, where the address period, or addressing time, Ta,n is the same for each subfield. The address time Ta,n may be reduced by the so-called line-doubling method, applied to some of the least significant subfields, and this is shown in the lower half of FIG. 2. In this method, a field, as shown in FIG. 2 comprises, say, 8 subfields (in practice, 6 up to 12 subfields are used). Each subfield may comprise an erase period for conditioning the panel, an address period for priming the cells that should be lit during sustaining, and a sustain period during which the actual light is generated. The sustain period of each subfield is given, for example, a weight of 128, 64, 32, 16, 8, 4, 2, or 1 corresponding to an 8-bit digital signal (b7,b6,b5,b4,b3,b2,b1) and allowing to obtain 256 luminance levels. The total sustain period for one field should be as long as possible in order to obtain a high brightness.

The erase period can be rather short, say, 0.2 ms , i.e. 8×0.2 ms=1.6 ms per field. The address period is about 3 $\mu$s per line. For a VGA display, comprising 480 display lines, the address period per subfield equals 480×3 $\mu$s=1.5 ms. At 8 subfields per field, the total address period is therefore 12 ms. At a field rate of 60 Hz (period 16.6 ms), only 3 ms is left as the total sustain period per field.

Figure 3:
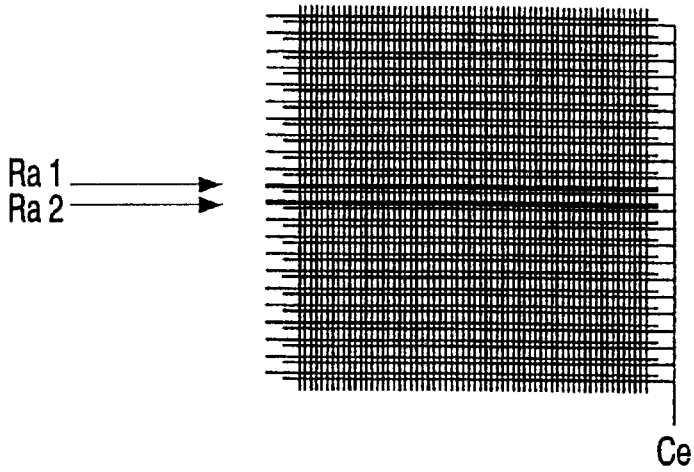

FIG. 3 shows how two adjacent rows $Ra_1$ and $Ra_2$ are addressed at the same time, with the same data. The address time Ta,s is thereby reduced, leaving more time for the sustain period S. The high bars referred to as E represent the erase periods. The triangles referred to as A represent the address periods, and the rectangles referred to as S represent the sustain periods. The line doubling which occurs during the period Td causes a time gain Tg which can be used to increase the duration of the sustain period S or to increase the number of subfields.

Figure 4:
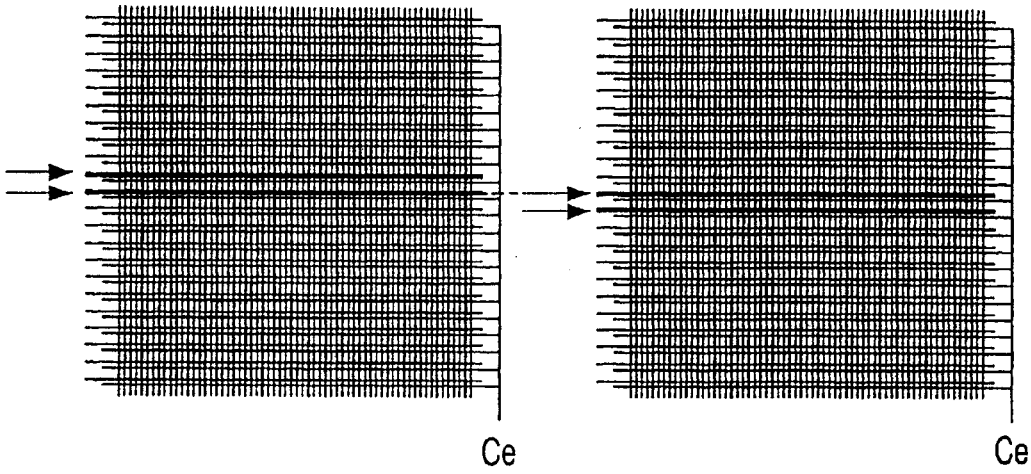

FIG. 4 shows an example where lines are grouped in line pairs for odd fields, and in other pairs of lines, shifted by one line, for even fields.

Figure 5:
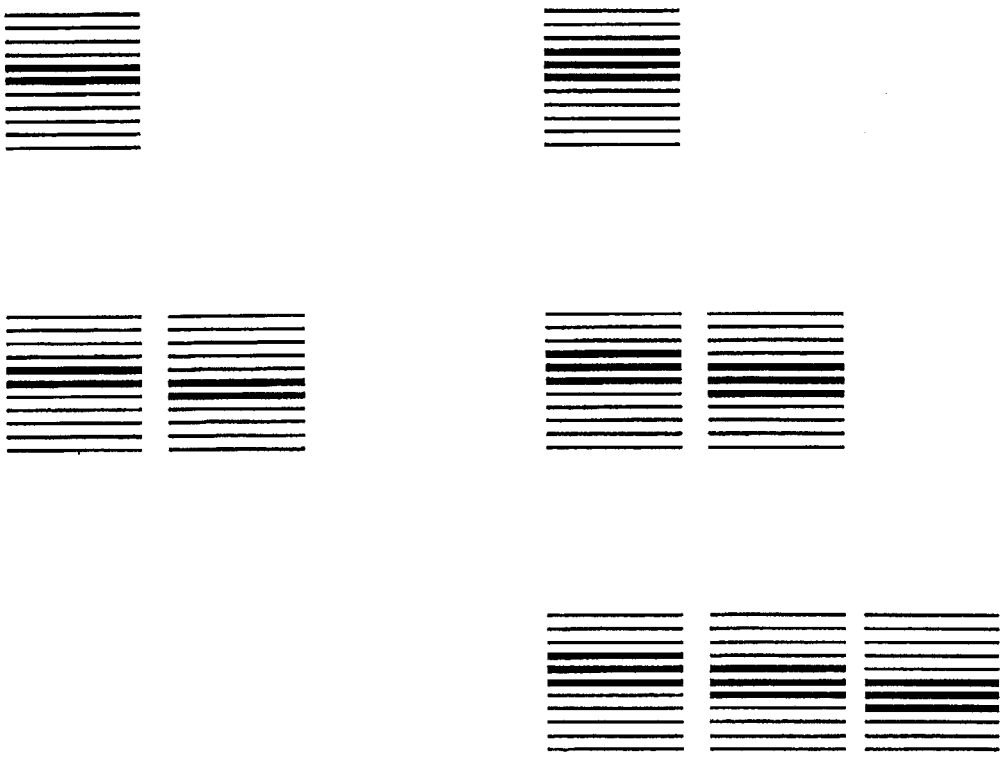

FIG. 5 shows, (upper left example) how, for all frames and all subfields, the lines are grouped in pairs (double line, single frame addressing). In the second example on the left, lines are grouped in pairs of lines in odd frames, and in shifted pairs of lines in even frames (double line, dual frame addressing). In the third example (upper right example), lines are grouped in sets of three lines for all frames and some subfield(s) (triple line, single frame addressing). The addressing time for said subfield(s), is thereby reduced to one third. In the fourth example (middle right example), lines are grouped in sets of three lines in odd frames, and in other sets of three lines, shifted by one line, for even frames (triple line, dual frame addressing). The last example of FIG. 5 (lower right example) shows triple line, triple frame addressing. The sets of three lines are shifted by one line for each successive frame.

Figure 6:
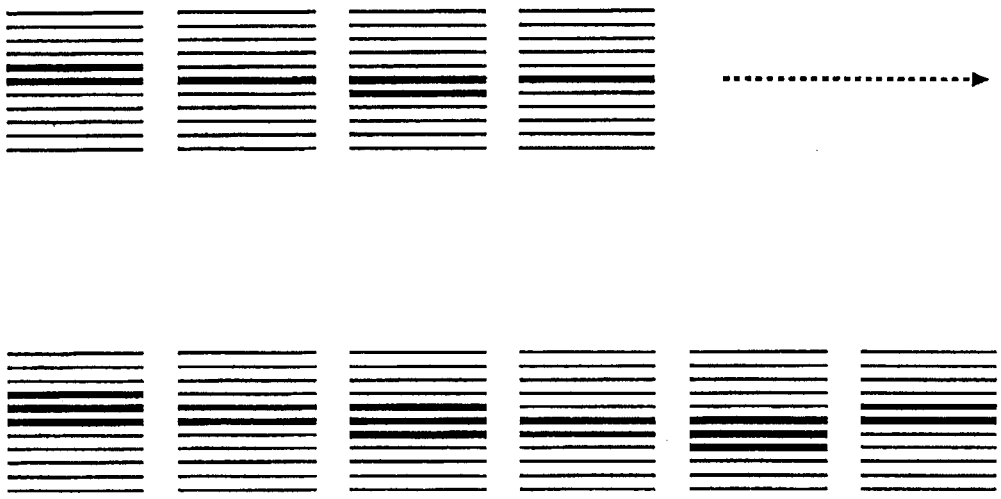

A wide range of combinations may be realized. FIG. 6 shows further examples of valid combinations. In the upper example of FIG. 6, double line addressing is used in odd frames or in the odd fields, and single line addressing is used in even frames or in the even fields. In the lower example of FIG. 6, triple line, triple frame addressing is interspersed with double line, double frame addressing.

The above methods may be applied differently for each subfield. The loss of definition resulting from triple line addressing may be acceptable if using triple (or higher-multiple) line addressing for the lowest least significant subfields, and double line addressing for the higher least significant subfields.

Figure 7:
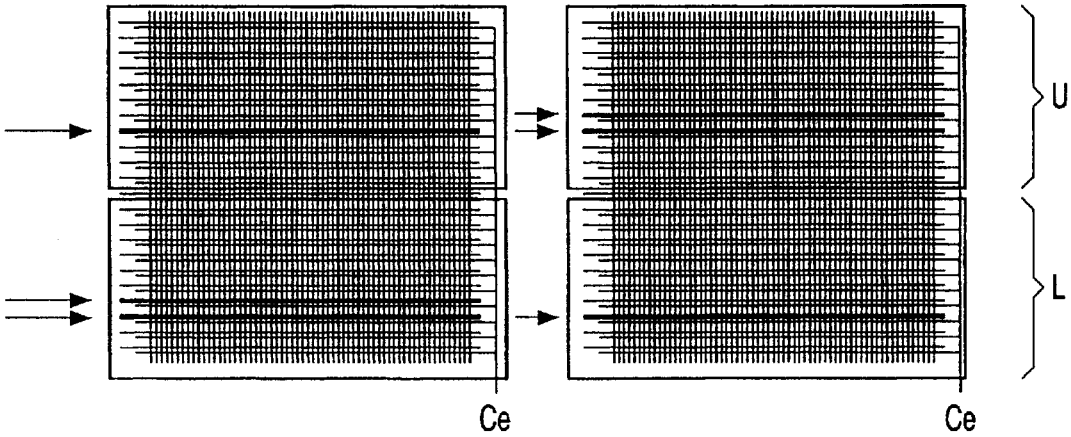

The above methods can also be applied differently for different regions of the display (multiple surface addressing). FIG. 7 shows an example of a display device that is independently addressable in the upper and the lower half regions (U and L). In this example, one method is applied for the upper half region, and another method is applied for the lower half region, for one frame or field, and the methods are reversed for the next successive frame or field.

Figure 8:
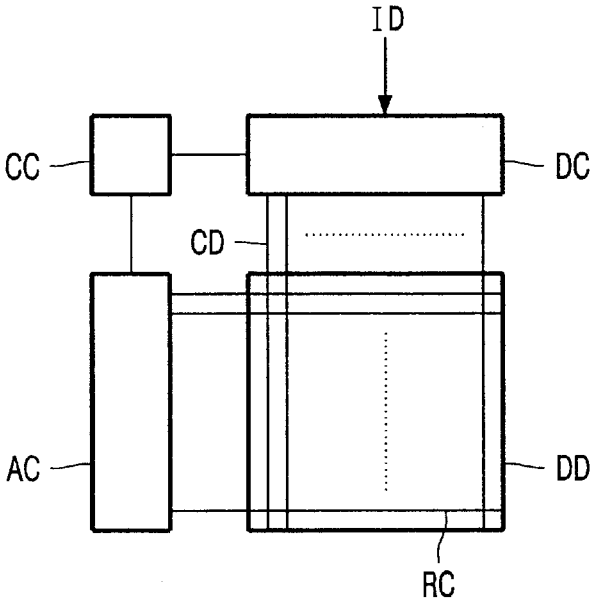

FIG. 8 shows a block diagram of a display apparatus.

A subfield driven matrix display device DD has row conductors RC selected by an addressing circuit AC. A data supplying circuit DC receives image data ID to supply data to column conductors CD. A control circuit CC controls the addressing circuit AC and the data supplying circuit DC.

For example, during the address period A of a predetermined subfield, the control circuit CC instructs the addressing circuit AC to address (select) two adjacent row conductors and instructs the data supplying circuit to supply the same data to the selected row conductors to prime two rows with the same data.

During the sustain period, the control circuit CC instructs the addressing circuit AC to supply a number of sustain pulses to the row conductors corresponding to the weight of the subfield.

Figure 9:
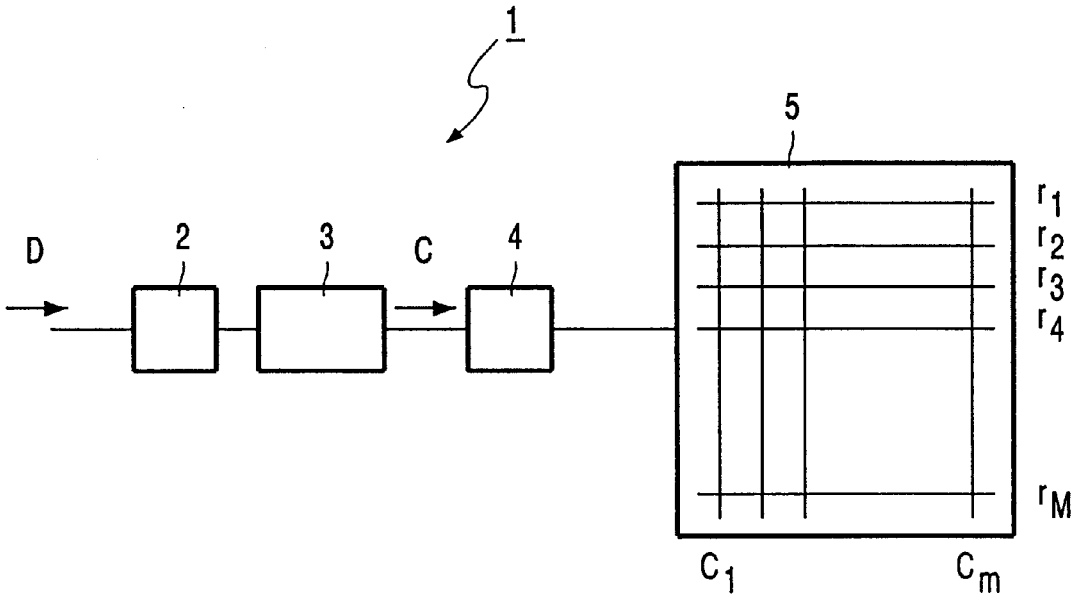

FIG. 9 is a schematic diagram of a device comprising a matrix display panel 5, showing a set of display lines (rows) $r_1, r_2, \ldots r_m$. The matrix display panel 5 comprises a set of data lines (columns) $c_1 \ldots c_N$ extending in a second direction, usually called the column direction, intersecting the first set of data lines, each intersection defining a pixel (dot) $d_{11} \ldots d_{NM}$. The number of rows and columns need not be the same.

The matrix display furthermore comprises a circuit 2 for receiving an information signal D comprising information on the luminance of lines to be displayed and a driver circuit 4 for addressing the set of data lines (rows $r_1, \ldots r_M$) in dependence on the information signal D, which signal comprises original line luminance values $D_1, \ldots D_M$.

The display device in accordance with the invention comprises a computing unit (3) for computing new line luminance values C of pixels $d_{11}, \ldots d_{NM}$ on the basis of original line luminance values $D_1, D_2, \ldots D_m$.

An example of how the prior-art methods (i.e. simple copy of bits, or averaging) are improved is given below, in a case where eight sub-fields are used, grouped in 4 more significant sub-fields which are addressed individually for each line, and 4 less significant sub-fields which are addressed simultaneously on 2 lines with common values.

Even though the average value for applying partial line doubling yields reasonable results if the more significant sub-fields are left unchanged, better results can be obtained in some cases. Changing also the more significant sub-fields when line doubling is applied reduces the error.

For instance, if we have the two following original luminance values A and B of pixels in the 8 bit grey scale levels:

A=31=0001 1111

B=32=0010 0000

For 4 less significant bits addressed at the same time (doubled), while taking the average value (rounded at the closer lower integer) on 4 less significant bits yields (the average is (1111+0000)/2, the integer part of which is 0111):

| | |
|---|---|
| A' = 23 = % 0001 0111<br>B' = 39 = % 0010 0111 | MSE = 56.5 |

where MSE is the mean square error:

$$MSE = \frac{(A - A')_2 + (B - B')_2}{2}$$

Taking the average value of the 4 less significant bits therefore leads to a considerable MSE in this example.

However, instead of taking the average value, if we add only 1 to A, the new 4 less significant values of A and B are now the same:

| | |
|---|---|
| A' = 32 = % 0010 0000 | MSE = 0.5 |
| B' = 32 = % 0010 0000 | |

A line doubling on the 4 less significant sub-fields can now be applied and the difference between old and new values is only 1, so the error is 1 for the first line, and zero for the second line. Then the MSE is minimized. To achieve this result, one can see that not only the less significant sub-fields, but also the more significant sub-fields are changed between A and A'.

In the case of 4 less significant binary sub-fields addressed with line doubling and when the error is higher than 8, the error can be reduced to a value lower than 8 by changing the values of the more significant sub-fields.

In the following method, the value of the more significant sub-fields can be changed. Here, "A" is the original data of a first line of a pair of lines to be displayed, "a" is the weight of the less significant sub-fields of said first line, "B" is the original data of the other line of said pair of lines, "b" is the weight of the less significant sub-fields of said line, A' is the new data for said first line, B' is the new data for said other line, r is a real number, and n is the number of doubled less significant sub-fields.

```
Δ = a − b
if(Δ > 0)                    Δ' = 2^n − Δ
else                         Δ' = 2^n − Δ
if (abs(Δ) > 2^(n−1))
{                            A' = A + int(Δ'*r)}
                               B' = B − Δ' + int(Δ'*r)}
else
{                            A' = A − (Δ*r)
                               B' = B + Δ − int(Δ*r) }
```

In the above expressions, "int( )" means taking the integral part of the expression between brackets. "abs ( )" means that the absolute value of the expression between brackets has to be determined. The parameter r may be given a value of ½. In that case, the mean square error is minimized. Other values may be given, e.g. A/(A+B), thereby spreading the largest part of the error to the largest of A and B, and spreading the relative error evenly.

The new values A' and B' obtained in accordance with this method have the same less significant sub-fields.

This calculation method will provide good results. However, when the original values of A and B are almost equal to 0 or 255 (minimum and maximum values, when using 8 binary sub-fields), problems of over-ranging can appear.

For instance, if

A=254=1111 1110

B=66=0100 0010 the above minimization method will give

A'=256=1 0000 0000

B'=64=0100 0000 however, in an eight sub-field system, A' will overflow to zero.

The new values are completely wrong (over-ranging). Better values may be obtained, by taking, in this case, the average value of the less significant sub-fields.

A'=248=1111 1000

B'=72=0100 1000

Therefore, if the new values A' or B' obtained are outside the limits of acceptable values, i.e. 0, . . . 255 for eight sub-fields, the following step is added to the method, taking the average instead of the obtained values.

```
if(      A' < 0 or
         B' < 0 or
         A' > 255 or
         B' > 255 )
{        A' = A − int(Δ*r)
           B' = B + Δ− int(Δ*r)
```

Figure 10:
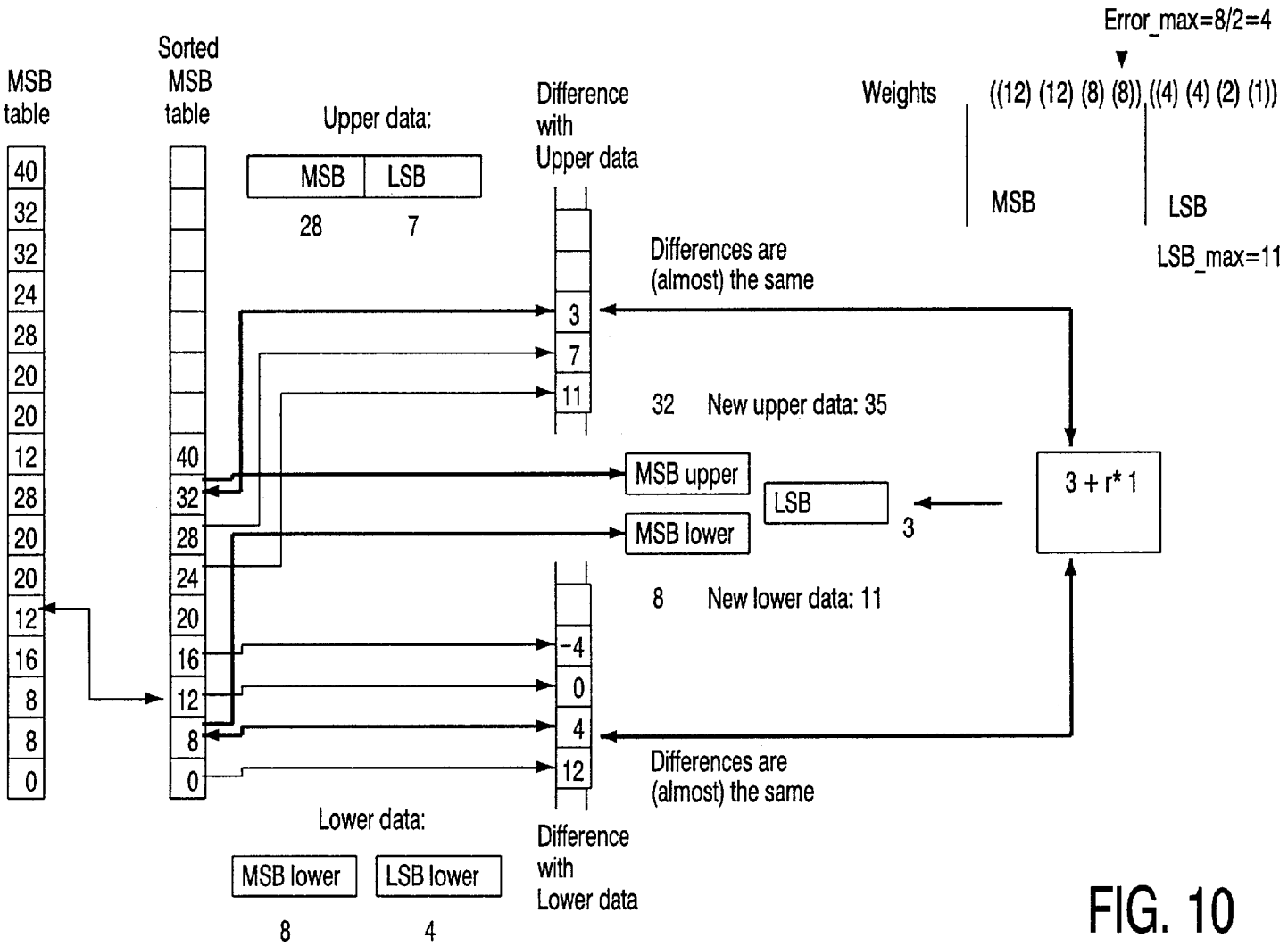

FIG. 10 schematically shows a numerical example also applicable to non-binary sub-fields. Eight sub-fields, having weights 12, 12, 8, 8 (more significant sub-fields) and 4, 4, 2, 1 (least significant sub-fields) are used. In the following, "A" is the weight of the more significant sub-fields of the original data of a first line of a pair of lines to be displayed, "a" is the weight of the less significant sub-fields of said first line, "B" is the weight of the more significant sub-fields of the original data of the other line of said pair of lines to be displayed, "b" is the weight of the less significant sub-fields of said line.

The method comprises the steps of:

(a) computing lsb_max as the addition of the weights of all less significant sub-fields (in this case 4+4+2+1, being 11);

(b) building a table ('MSB table') of the weight of all possible combinations of the more significant sub-fields;

These steps are executed once;

The following steps are executed for each dot of each pair of lines:

(c) building a first corresponding table of the differences between the data A+a of the first line of a pair of lines to be displayed, and each element of the MSB table ('first differences set')

(d) building a second corresponding table of the differences between the data B+b of the other line of said pair of lines, and each element of the MSB table ('subsequent differences set')

(e) determining, among all pairs of values, the first one taken from the first differences set and the second one taken from the second differences set, the pairs of values, so that the absolute value of their difference is minimum among all said pairs ('minimal pairs') (in this case, the smallest difference is 1 and may be obtained by taking the values 3 and 4 (first minimal pair) or the values 11 and 12 (second minimal pair));

(f) determining, for all said minimal pairs, c as being the integral part of the sum of the lowest of the pair of determined difference values (MIN(A+a−A'),(B+b−B'))) plus the absolute value of their difference multiplied by r,(r*ABS((A+a−A')−(B+b−B'))) r being a real number, if said integral part is positive and smaller than twice lsb_max;

zero if said integral part is negative;

lsb_max if said integral part is larger than twice lsb_max.

(g) determining, for all said minimal pairs, the error as being the absolute value of A+a−A'−c+B+b−B'−c;

(h) selecting, among all minimal pairs, a pair having the smallest error('selected minimal pair') (here both minimal pairs give the same result and any of them may be chosen);

(i) determining the weight of the more significant sub-fields of the new data of said first line to be displayed as being the element of the MSB table corresponding to the first element of the selected minimal pair(here 32 for the first minimal pair, and 24 for the second minimal pair);

(j) determining the weight of the more significant sub-fields of the new data of said other line to be displayed as being the element of the MSB table corresponding to the second element of the selected minimal pair (here 8 for the first minimal pair, and 0 for the second minimal pair);

(k) determining the weight of the less significant sub-fields of the new data for both said first and said other line to be displayed as being the value of c for the selected minimal pair (here taking r as ½, C is 3 for the first minimal pair, and 11 for the second minimal pair).

Preferably prior to step c, a value error_max is computed, determined or set, error_max being half the weight of the lowest more significant sub-field (in this case error_max is equal to 4). In the first corresponding table, the values comprised between minus error max and lsb_max+error_max (in this case between −4 and 15) are selected as a reduced first difference set (only these values are shown in the diagram, here 3, 7 and 11), and in the second corresponding table, the values between minus error_max and lsb_max+error_max are selected as a reduced second difference set (again only these values are shown in the diagram, here −4, 0, 4, 12), and in step e determining, among all pairs of values, the first one being taken from the reduced first differences set and the second one being taken from the reduced second differences set, the pairs of values, so that the absolute value of their difference is minimum among all said pairs ('minimal pairs') (in this case the minimum is 1 and may be obtained by taking the values 3 and 4 (first solution) or 11 and 12 (second solution). In this preferred embodiment, the number of pairs to be considered is strongly reduced, thus increasing the speed of the method.

Steps (d) and (e) may be performed more easily if the MSB table is first sorted, and duplicate values are eliminated, as shown in FIG. 10.

The first solution gives 32+3=35 for the upper line and 8+3=11 for the lower line. The second solution gives 24+11=35 for the upper line and 0+11=11 for the lower line. The error is equal for both solutions. The first solution is displayed in bold on FIG. 2. As above, parameter r may be chosen for spreading the error differently between the two lines.

Using non-binary sub-fields, the relationship between luminance values, and sub-field combination is not one-to-one, as with binary sub-fields. In the above scheme, the value 20, may be obtained by e.g. 12+8 or by 8+8+4, which are different combinations among more and less significant fields. The method provides values for the more significant fields which are obtainable by a combination of more significant fields. This method provides new values to be displayed, reducing the error and spreading the error evenly among the first and the subsequent line.

The above method applies to two lines. It may be generalized to sets of three or more lines, as follows. Steps (d) and (e) are performed for each line of the set of lines. In step (h), a set of values is searched among all combinations of differences sets, which gives the smallest differences. Step (i) is also performed for each line of the set of lines.

Figure 11:
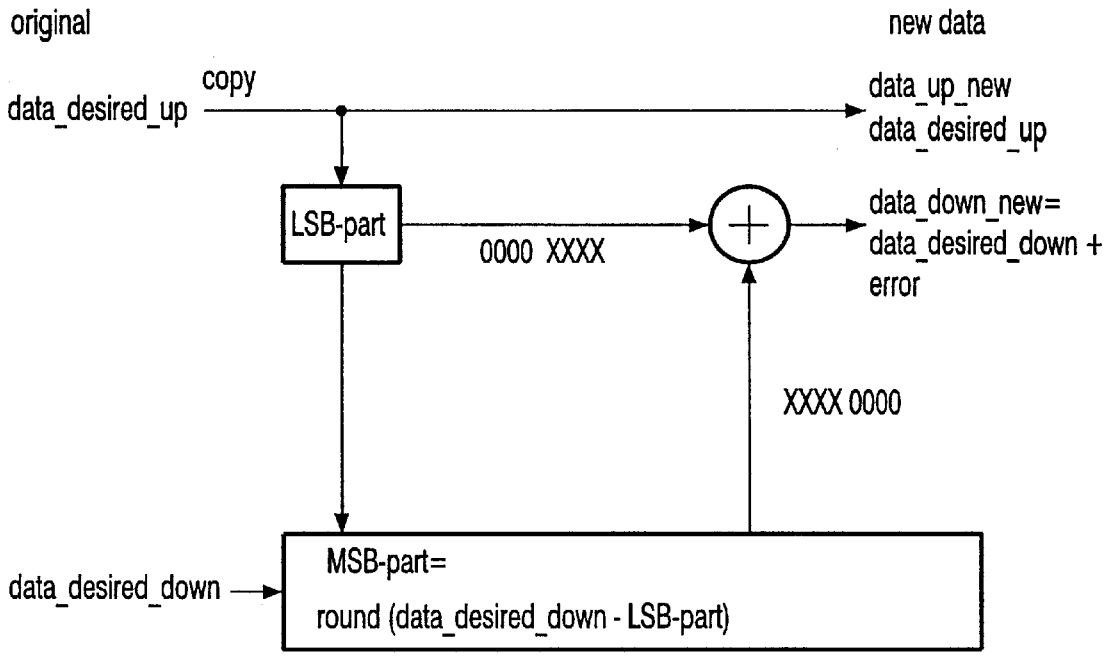

As shown in FIG. 11 in a further method, the luminance data for one of the pairs of lines is simply used as data to be displayed. (data_up_new=data_desired_up).

The weight of the less significant sub-fields is extracted (LSB-part).

One computes the weight of the more significant sub-fields of the new luminance value data of a second line of a pair of lines by subtracting LSB from the original data for said line, and by rounding obtained value to the nearest combination of most significant sub-fields value.

For the new luminance value data of a second line of a pair of lines, one takes the computed weight for the more significant sub-fields, and LSB for the less significant sub-fields. In the numerical example of this method, shown in FIG. 12, the original value of a first line is 3 (0000 0011 in binary), and the original value of a second line is 141 (1000 1101 in binary). The first value is simply copied. The less significant sub-fields (0011 in binary) are extracted. A new value for the more significant sub-fields of the second line is obtained by subtracting the LSB from the original value for the second line. The rounding may be performed by adding half the value of the lower more significant field, in this case 8, and taking the more significant sub-fields thereof.

Figure 12:
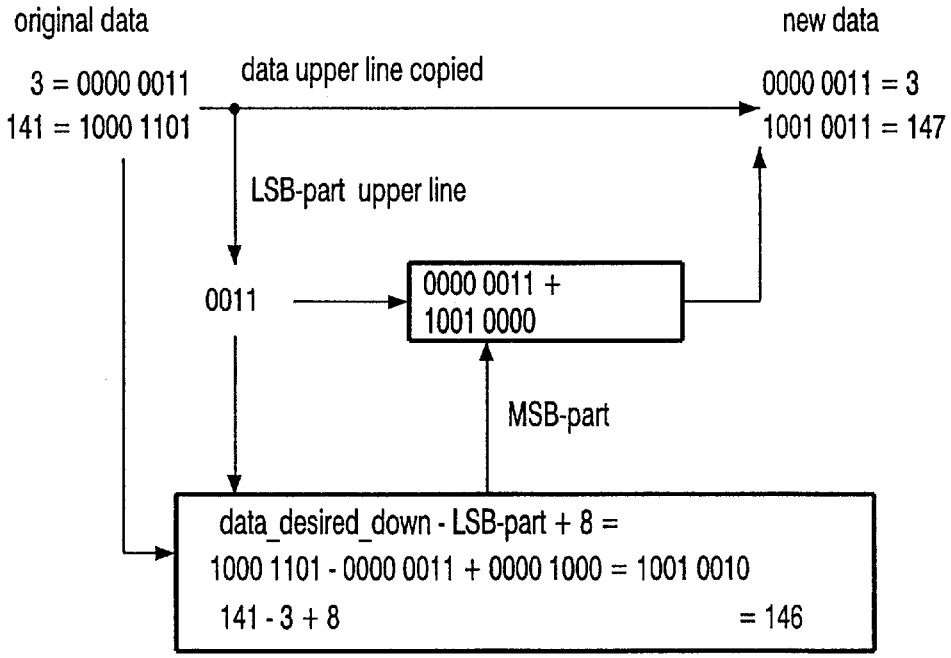

Although the numerical example shown in FIG. 12 relates to binary sub-fields, this method also applies to non-binary sub-fields.

This method may be improved by taking, as the first line, the line with the smallest LSB sub-fields.

Figure 13:
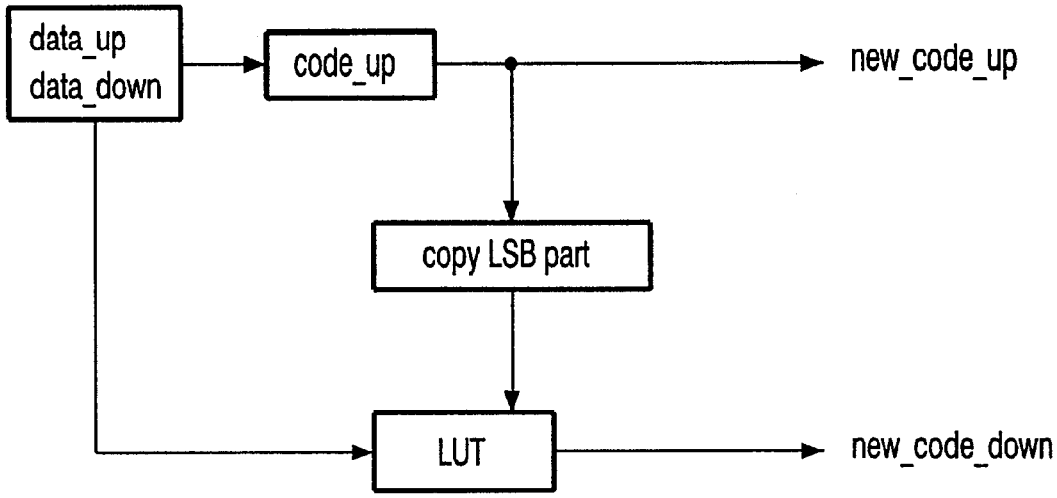

All of these methods may easily be implemented in a programming language, the program having, as input, the original luminance values to be displayed, and, as output, the new luminance values. Alternatively, a look-up table mechanism may be used. A table ('look-up table') has an entry for each pair of values of the original luminance values, and contains the corresponding precalculated pair of new values. A drawback of this is that the look-up table may be very large, i.e. 256×256 elements for 8 bits binary sub-fields. For the method as defined in claim 13, a smaller look-up table may be used, having, as shown in FIG. 13, an entry for each combination of values of the second line and of values of the LSB-part, i.e. 256×16 elements for 8 bits binary sub-fields. A substantial reduction of the look-up table size is thereby obtained. This method is applicable to non-binary sub-fields.

Figure 14:
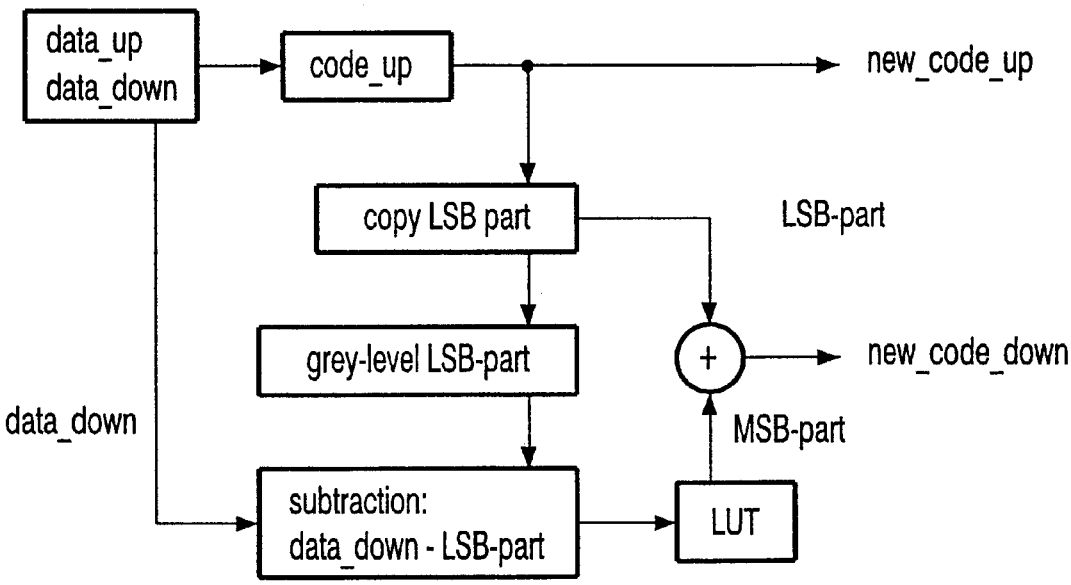

In FIG. 14, the size of the look-up table is further reduced: one computes the difference between the luminance value for the second line, and the luminance value corresponding to the LSB part. This difference is used as input in a look-up table for giving the new most significant fields.

The description above is also substantially part of co-pending patent applications from applicant. The above subject matter can be incorporated in the following preferred embodiment of the present invention.

The limited number of subfields of a matrix display also limits the number of grey levels that can be displayed by such matrix display. The Human Visual System integrates light coming from neighboring pixels into one luminance level. Dithering uses this property by displaying high spatial frequencies which are perceived as a certain grey level. In this way the number of perceived grey levels can be enhanced.

In the preferred embodiment of the present invention Floyd-Steinberg error diffusion is used—see for instance R.

W. Floyd and L. Steinberg: An adaptive algorithm for spatial grayscale Proceedings of SID Vol 17/2 pp. 75, 1976. This error diffusion algorithm is schematically shown in FIG. 15. Because the original image data consist of more grey levels than can be displayed on e.g. a Plasma Display Panel (PDP), an error is made for each pixel P. This error is distributed over the surrounding pixels: 7/16 of the error to pixel A, 1/16 of the error to pixel B, 5/16 of the error to pixel C and 3/16 of the error to pixel D. The resulting luminance will be close to the intended luminance because of the above mentioned integration/ effect of the Human Visual System.

The present invention makes it possible to combine Partial Line Doubling (PLD) and dithering. The quality of the dithering will depend largely on the subfield with the lowest weight. Dark areas will be critical for the dithering quality due to the non-linear perception of the Human Visual System. The human eye is more sensitive for luminance changes at low luminance values than at high luminances values. If, however, PLD is performed after the dithering, experiences have shown that the picture quality is deteriorated as compared to a picture with only error diffusion. The resolution limitation due to PLD is especially visible for the human eye in the dark areas, as always two adjacent least significant subfields are turned on simultaneously.

If the error diffusion is integrated with PLD, dithering is done on a two by one pixel basis. This means that the error over 2 pixels is distributed over the neighboring pixels. This improves the picture quality. The resolution limitation due to PLD, however, still remains.

In FIG. 16 the combination of dithering and Partial Line Doubling according to the present invention is shown. FIG. 16A shows Partial Line Doubling for two subfields with the lowest value. According to FIG. 16B the least significant subfield is used for dithering, preferably using resolution while the next subfields are doubled according to Partial Line Doubling.

Hereby the quality of error diffusion will increase because the least significant subfield can be turned on individually for each line, increasing the resolution.

The least significant subfields that are addressed individually for each line should be incorporated in the calculations when performing Partial Line Doubling.

Figures 17, 18:
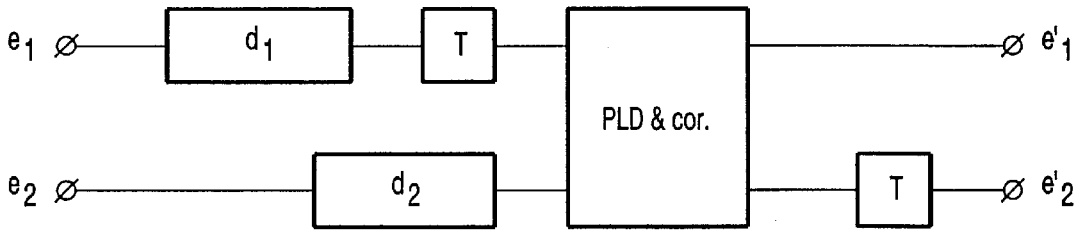
FIG. 17 shows numerical examples of a preferred embodiment of a method according to the present invention.
FIG. 18 shows a implementation example for a preferred method of the present invention.

It is preferred to also make a correction when performing Partial Line Doubling. FIG. 17 gives a few examples of data. The doubled subfields are printed bold. The first column shows the original data and the second column shows the data after Partial Line Doubling. The third column shows the Partial Line Doubling shifted relative to the less significant subfield over one bit position. The fourth column shows the data with correction whereby the error is minimized.

In principal the correction can be simple the subfields with the lowest weights that are not doubled (in this example only the least significant subfield) are called the Least Significant Part (LSP). The subfields that are involved in the Partial Line Doubling algorithm (in this example the 7 more significant subfields) are called the MSP-part. If the MSP-part has a higher value after Partial Line Doubling, the LSP should be set to zero, while the LSP should be set to one if the value of the MSP-part is lower after Partial Line Doubling.

According to the above described algorithm for Partial Line Doubling more than half of the number of subfields can be doubled without noticeable picture deterioration. Therefore two or more bits are reserved for dithering, preferable including the above described correction.

Experiments have shown that the most preferred embodiment is when the two least significant subfields are reserved for dithering and therefore Partial Line Doubling takes place for the middle two subfields.

FIG. 18 shows the preferred embodiment of the algorithm for the method according to the present invention.

The data from an odd line $e'_1$ are first dithered $d_1$, subsequently delayed (T) over one line interval and combined with the even line data $e'_2$ which have also been dithered $d_2$, so that Partial Line Doubling including correction (PLD & Cor) can be executed while the one or two least significant subfields are reserved for dithering. Thereafter the data for the even line are also delayed (T) over a time interval T before data $e'_1$ and $e_2$ are being supplied together to a matrix display panel, in the present preferred embodiment a plasma display panel.

Figure 19:
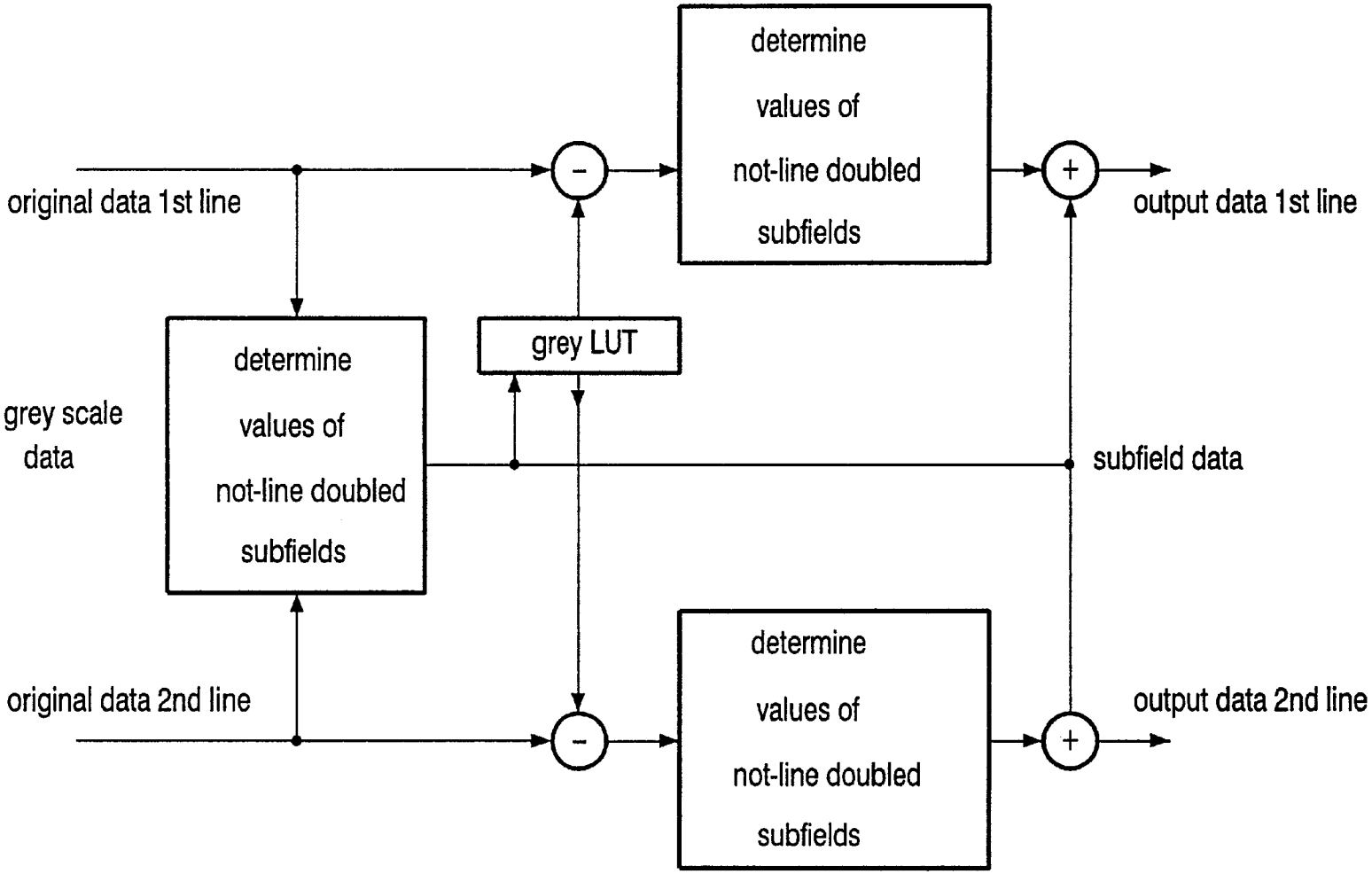
FIG. 19 shows a further implementation example for a preferred method of the present invention.

Another method that is applicable to non-binary subfield values is shown in FIG. 19. The luminance data of both lines of the pair of lines is used to calculate the values of the double line addressed subfields. This can be done by taking the average value of the double line addressed subfields. Another option is to choose the values of the double line addressed subfields of the line with the lowest luminance data values. Another option is to choose the values of the double line addressed subfields of the line where these subfields have the lowest values. The values of the single line addressed subfields can be determined by calculating the luminance that is already displayed on both lines by the double line addressed subfields (grey LUT) and subtracting this value from the original intended luminance of both lines. The result is used as an entry of a LUT (Look Up Table) that gives the closest combination of single line addressed subfields. The final subfield data of both lines can de determined by joining the values of the double line addressed subfields with the values of the single line addressed subfields of both lines.

The present invention is not limited to the above description preferred embodiment thereof, the rights sought for being defined by the following claims, within the scope of which modifications can be envisaged.

What is claimed is:

1. A method of displaying successive image frames of fields on a matrix display device, said display device comprising a predetermined number of display lines each including a predetermined number of picture elements (pixels), wherein said pixels are coded in sub-fields, said matrix display device is driven by said sub-fields, and luminance values having a higher number of bits or gray levels than the number of bits or gray levels to be displayed by a pixel element, said method comprising the steps:

using one or more of the sub-fields with the lowest or lower weight(s)in a dithering process; and addressing two or more lines simultaneously for supplying common values to one or more sub-fields having a higher weight than said lowest or lower weight(s) of the pixels of said lines with respective common values, wherein the sub-fields have weights proportional to successive powers of two, the luminance value data being larger than or equal to zero, and smaller than two to the Nth power ($2^N$), N being the number of sub-fields, "A" being the original data of a first line of a pair of lines to be displayed, "a" being the weight of the simultaneously addressed sub-fields of said first line, "B" being the original data of the other line of said pair of lines, "b" being the weight of the simultaneously addressed sub-fields of said line, n being the number of simultaneously addressed sub-fields plus the number of low-weight sub-fields used in the dithering process, r being a real number, and wherein the method comprises the steps:

computing a difference Δ of a minus b (Δ=a−b);

a computing α' as being 2 to the nth power minus Δ ($\Delta'=2^n-\Delta$) if Δ is positive, and else being minus 2 to the nth power minus Δ ($\Delta'=-2^n-\Delta$);

computing a new value for A (A') as being equal to the original value of A plus the integral part of the value of Δ' multiplied by r (A'=A+int(Δ'*r)), and a new value for B (B') as being equal to the original value of B minus Δ' plus the integral part of the value of Δ' multiplied by r (B'=B−Δ'+int(Δ'*r)), if the absolute value of Δ is larger than 2 to the (n−1)th power, and else a new value for A (A') as being equal to the original value of A minus the integral part of the value of Δ multiplied by r (A'=A−int(Δ*r), and a new value for B (B') as being equal to the original value of B plus Δ minus the integral part of the value of Δ multiplied by r (B'=B+Δ−int(Δ*r));

if said new value of A or said new value of B is smaller than zero, or equal to or larger than 2 to the Nth power, replacing said new values of A and B, respectively, by the original value of A minus the integral part of the value of Δ multiplied by r (A−int(Δ*r), and by the original value of B plus Δ minus the integral part of the value of Δ multiplied by r (B+Δ−int(Δ*r)).

2. The method as claimed in claim 1, wherein r is given the value one half (r=½).

3. The method as claimed in claim 1, wherein r is given the value A divided by the sum of A and B (r=A/(A+B)).

4. A method of displaying successive image frames of fields on a matrix display device, said display device comprising a predetermined number of display lines each including a predetermined number of picture elements (pixels), wherein said pixels are coded in sub-fields, said matrix display device is driven by said sub-fields, and luminance values having a higher number of bits or gray levels than the number of bits or gray levels to be displayed by a pixel element, said method comprising the steps:

using one or more of the sub-fields with the lowest or lower weight(s)in a dithering process; and addressing two or more lines simultaneously for supplying common values to one or more sub-fields having a higher weight than said lowest or lower weight(s) of the pixels of said lines with respective common values, wherein "A" is the weight of the single line addressed sub-fields of the original data of a first line of a pair of lines to be displayed, "a" is the weight of the double line addressed sub-fields of said first line, "B" is the weight of the single line addressed sub-fields of the original data of the other line of said pair of lines to be displayed, "b" is the weight of the double line addressed sub-fields of said line, and n is the number of least significant sub-fields, and wherein the method comprises the steps:

(a) computing lsb_max as being the sum of the weights of all double line addressed sub-fields;

(b) building a table ('MSB table') of the weight of all possible combinations of the single line addressed sub-fields;

(c) building a first corresponding table of the differences between the data A+a of the first line, and each element of the MSB table('first differences set', A+a−A');

(d) building a second corresponding table of the differences between the data B+b of the other line of said pair of lines, and each element of the MSB table ('subsequent differences set', B+b−B');

(e) determining, among all pairs of values, the first one taken from the first differences set and the second one taken from the subsequent differences set, the pairs of values, so that the absolute value of their difference is minimum among all said pairs ('minimal pairs');

(f) determining, for all said minimal pairs, c as being:

the integral part of the sum of the lowest one of the pair of determined difference values (MIN(A+a−A'), (B+b−B'))) plus the absolute value of their difference multiplied by r, (r*ABS((A+a−A')−(B+b−B'))) r being a real number, if said integral part is positive and smaller than twice lsb_max, zero if said integral part is negative, or lsb_max if said integral part is larger than twice lsb_max;

(g) determining, for all said minimal pairs, the error as being the absolute value of A+a−A'−c+B+b−B'−c;

(h) selecting, among all minimal pairs, a pair having the smallest error ('selected minimal pair');

(i) determining the weight of the single line addressed sub-fields of the new data of said first line to be displayed as being the element of the MSB table corresponding to the first element of the selected minimal pair;

(j) determining the weight of the single line addressed sub-fields of the new data of said other line to be displayed as being the element of the MSB table corresponding to the second element of the selected minimal pair; and (k) determining the weight of the double line addressed sub-fields of the new data for both said first and said other line to be displayed as being the value of c for the selected minimal pair.

5. The method as claimed in claim 4, wherein, prior to step (c), a value error_max is computed, determined or set, error_max being half the weight of the lowest single line addressed sub-field, the values comprised between minus error_max and lsb_max+error_max being selected in the first corresponding table as a reduced first difference set, and the values between minus error_max and lsb_max+error_max being selected in the second corresponding table as a reduced second difference set, and in step (e), among all pairs of values, the first one being taken from the reduced first differences set and the second one being taken from the reduced second differences set, the pairs of values, so that the absolute value of their difference is minimum among all said pairs ('minimal pairs').

6. The method as claimed in claim 4, wherein r is given the value one half (r=½).

7. The method as claimed in claim 4, wherein r is given the value of the sum of A plus a divided by the sum of A, a, B and b (r=(A+a)/(A+a+B+b)).

* * * * *